US010641142B2

(12) United States Patent
Altherr

(10) Patent No.: US 10,641,142 B2
(45) Date of Patent: May 5, 2020

(54) VALVE TRAIN FOR AN INTERNAL COMBUSTION ENGINE

(71) Applicant: Mahle International GmbH, Stuttgart (DE)

(72) Inventor: Patrick Altherr, Stuttgart (DE)

(73) Assignee: Mahle International GmbH (DE)

( * ) Notice: Subject to any disclaimer, the term of this patent is extended or adjusted under 35 U.S.C. 154(b) by 78 days.

(21) Appl. No.: 15/749,113

(22) PCT Filed: Aug. 5, 2016

(86) PCT No.: PCT/EP2016/068798
§ 371 (c)(1),
(2) Date: Jan. 30, 2018

(87) PCT Pub. No.: WO2017/025477
PCT Pub. Date: Feb. 16, 2017

(65) Prior Publication Data

US 2018/0216505 A1 Aug. 2, 2018

(30) Foreign Application Priority Data

Aug. 7, 2015 (DE) ..... 10 2015 215 123

(51) Int. Cl.
*F01L 1/34* (2006.01)
*F01L 13/00* (2006.01)
(Continued)

(52) U.S. Cl.
CPC ..... *F01L 13/0005* (2013.01); *F01L 1/18* (2013.01); *F01L 13/0036* (2013.01);
(Continued)

(58) Field of Classification Search
CPC ..... F01L 1/18; F01L 13/0036; F01L 1/267; F01L 13/0005; F01L 2013/001
(Continued)

(56) References Cited

U.S. PATENT DOCUMENTS 8,714,125 B2 * 5/2014 Kamichika ..... F01L 1/047 123/90.16
2012/0222635 A1 9/2012 Sunada et al.
2014/0190432 A1 7/2014 McConville et al.

FOREIGN PATENT DOCUMENTS

DE 19945340 A1 3/2001
DE 102009005731 A1 8/2010
(Continued)

OTHER PUBLICATIONS

English abstract for DE-102014210734.
(Continued)

*Primary Examiner* — Ching Chang
(74) *Attorney, Agent, or Firm* — Fishman Stewart PLLC

(57) ABSTRACT

A valve train for an internal combustion engine may include a cam shaft and a cam follower. The valve train may also include a first cam arranged on the cam shaft for conjoined rotation. The valve train may further include a second cam arranged on the cam shaft for conjoined rotation and axially adjacent to the first cam. The cam follower may be axially adjustable between a first position, in which the cam follower is drive-connected to the first cam, and a second position, in which the cam follower is drive-connected to the second cam. The cam follower may include a mechanical adjustment device interacting with the cam shaft for axially adjusting the cam follower between the first position and the second position.

20 Claims, 3 Drawing Sheets

(51) Int. Cl.
*F01L 1/18* (2006.01)
*F01L 1/26* (2006.01)

(52) U.S. Cl.
CPC ..... *F01L 1/267* (2013.01); *F01L 2013/001* (2013.01); *F01L 2013/101* (2013.01); *F01L 2105/00* (2013.01)

(58) Field of Classification Search
USPC ..... 123/90.16, 90.18, 90.44
See application file for complete search history.

(56) References Cited

FOREIGN PATENT DOCUMENTS

| | | | |
|---|---|---|---|
| DE | 112009005395 | T5 | 9/2012 |
| DE | 102014210734 | A1 | 12/2015 |
| EP | 2487341 | A1 | 8/2012 |
| JP | 2014224496 | A | 12/2014 |
| WO | 2005080761 | A1 | 9/2005 |

OTHER PUBLICATIONS

English abstract for DE-19945340.
English abstract for JP-014224496.
English abstract for DE-102009005731.

* cited by examiner

VALVE TRAIN FOR AN INTERNAL COMBUSTION ENGINE

CROSS-REFERENCE TO RELATED APPLICATIONS

This application claims priority to International Patent Application No. PCT/EP2016/068798, filed on Aug. 5, 2016, and German Patent Application No. DE 10 2015 215 123.9, filed on Aug. 7, 2015, the contents of both of which are hereby incorporated by reference in their entirety.

TECHNICAL FIELD

By means of an adjustable, conventional valve train which comprises two cams of different cam stroke, the cylinder of an internal combustion engine can be operated in two different operating modes. If instead of two cams of different stroke only one single cam and—instead of a second cam—a base circle without a cam stroke is used, the cylinder can be disengaged by means of the valve train. In such a disengaged state, a cam follower coupled with a gas exchange valve of the cylinder does not interact with the single cam, but rather with said base circle, so that the gas exchange valve is not actuated.

BACKGROUND

A valve train of the type named in the introduction is known from DE 199 45 340 A1.

SUMMARY

It is an object of the present invention to indicate new ways in the development of valve trains.

This problem is solved by the subject of the independent claim(s). Preferred embodiments are the subject of the dependent claims.

The basic idea of the invention is, accordingly, to equip a valve train with a purely mechanical adjustment device, by means of which the cam follower can be adjusted between a first and a second axial position. In this way, the use of conventional adjustment means with pneumatic or hydraulic components can be dispensed with. This means a considerably simplified structural composition of the valve train, which is accompanied, in turn, by a reduced space requirement.

A valve train according to the invention comprises a cam shaft and a cam follower. A first cam and, axially adjacent thereto, a second cam, are mounted on the cam shaft for conjoined rotation. An axial direction can be defined through the central longitudinal axis of the cam shaft. The first cam can be arranged here axially at a distance from the first cam or can lie against the latter. The cam follower is axially adjustable along an axial direction. The cam follower can be axially adjusted here between a first position, in which the cam follower is drive-connected to the first cam, and a second position, in which the cam follower is drive-connected to the second cam. According to the invention, the cam follower has a mechanical adjustment device that interacts with the cam shaft and axially adjusts the cam follower between the first and the second position.

In a preferred embodiment, the mechanical adjustment device has an adjustable first mechanical engagement element. The latter interacts, for axial adjusting of the cam follower from the first into the second position, with a first slide guide present on the cam shaft. The adjustment device also has a producible second mechanical engagement element, which for the axial adjusting of the cam follower from the second into the first position interacts with a second slide guide present on the cam shaft. The use of such mechanical engagement elements allows technically complex pneumatic systems to be dispensed with.

According to a further development, the mechanical adjustment device comprises a first actuator. By means of the first actuator, the first mechanical engagement element is adjustable between a first position, in which it engages into the first slide guide, and a second position, in which it does not engage into the first slide guide. Alternatively or additionally, the mechanical adjustment device comprises a second actuator, by means of which the second mechanical engagement element is adjustable between a first position, in which it engages into the second slide guide, and a second position, in which it does not engage into the second slide guide. Also, the use of such actuators allows pneumatic and/or hydraulic adjustment means, which are technically only able to be realized with considerable effort, to be dispensed with for adjusting the respective engagement element.

Expediently, the first actuator is adjustable between an inactive position and an active position. Preferably, the adjustability can be realized such that the first actuator in the inactive position is out of contact with the first engagement element and by an adjusting from the inactive position into the active position adjusts the first engagement element through mechanical contact from the second into the first position. In this variant, the second actuator can also be adjustable alternatively or additionally to the first actuator between an inactive position and an active position. Analogously to the first actuator, the second actuator in the inactive position is out of contact with the second engagement element. By an adjusting from the inactive position into the active position, the second actuator adjusts the second engagement element through mechanical contact from the second into the first position. The use of purely mechanical means in the form of the actuators for adjusting the engagement means simplifies the structure of the entire valve train. This is accompanied by considerable cost savings in the production of the valve train.

Expediently, the adjusting of the first and/or second engagement element from the first into the second position takes place with the aid of the stroke movement of the cam follower. In other words, the cam follower is moved towards the two actuators by the stroke movement brought about by the first or second cam. When these are in their active position, then through the stroke movement of the cam follower and thereby of the respective engagement element, the respective engagement element is pressed against the respective actuator which is stationary, therefore immobile, in the active position with respect to the cam shaft, and in this way is "displaced" by the actuator into its second position. An active adjusting of the first or second engagement element by an active movement of the first or respectively second actuator can be dispensed with in this way. Accordingly, the two actuators can be composed in a structurally very simple manner, which leads to cost advantages in manufacture.

Particularly preferably, the two actuators can be configured as linearly adjustable, electrically driven actuators. In this case, they can be actuated in a simple manner by a control device of the valve train for adjusting between the active position and the inactive position. Furthermore, the realization as electric actuators permits are very accurate control of the linear positioning of the actuators along their adjustment direction. In this variant, the mechanical adjustment device is realized as an electromechanical adjustment device.

In a further preferred embodiment, the first actuator has a linearly adjustable first control element. This can comprise a cylindrical control body, the face side of which, on moving of the first engagement element into the first slide guide, presses against a face side of the engagement element lying opposite the first control element. In an analogous manner, the second actuator can also have a linearly adjustable second control element, which has a cylindrical control body. Its face side, in an analogous manner to the first control element, on moving of the second engagement element into the second slide guide can press against a face side of the second engagement element lying opposite the second control element. In the previously described manner, the desired mechanical coupling of the actuator with the engagement element can be realized in a simple and therefore favourably-priced manner.

In a further advantageous further development, the first actuator has a housing and a first control element which is adjustable in a translatory manner relative to the housing between the first and the second position. In this variant also the second actuator, alternatively or additionally to the first actuator, can have a housing and a second control element which is adjustable in a translatory manner relative to this housing between the first and the second position. By means of such control elements, which preferably have a pin- or bolt-like contact section, the necessary mechanical interaction of the actuators with the engagement elements can be realized in a simple manner, in order to bring the engagement elements, preferably in a form-fitting manner, in engagement with the slide guides.

In an advantageous further development of the invention, which requires particularly little installation space, the first and the second slide guide are configured in a common slide body, which is arranged axially on the same side of the cam follower roller relative to the two cams.

In a further preferred embodiment, the cam follower has a cam follower fixing device for the detachable fixing of the cam follower in the first or second position. According to this variant, the cam follower fixing device has a spring-loaded cam follower fixing element. This engages in the first position of the cam follower into a first mount provided on the cam follower, and in the second position of the cam follower into a second mount provided on the cam follower. Such a realization of a fixing mechanism for fixing the cam follower permits a reliable fixing of the cam follower in its first or second axial position and nevertheless requires only very little installation space.

Particularly preferably, because it involves particularly small manufacturing costs, the first mount is as a first circumferential groove, formed on the circumferential side of the cam follower. The second mound is formed here as a second circumferential groove arranged on the circumferential side, axially at a distance from the first circumferential groove.

Expediently, the cam follower has, for at least one engagement element, preferably for both engagement elements, an engagement element fixing device for the detachable fixing of the engagement element in the first or second position. In this variant, said engagement element fixing device has a spring-loaded fixing element. The latter, in the first position of the engagement element, is received in a first mount provided on the engagement element. In the second position of the engagement element, the fixing element is received in a second mount provided on the cam follower.

Preferably, the first and/or second engagement element have respectively a base body configured in a bolt-like or pin-like manner, on the circumferential side of which the first mount is formed as first circumferential groove, and the second mount is formed as second circumferential groove arranged axially at a distance.

Particularly expediently, the mechanical adjustment device comprises no hydraulic and/or pneumatic components.

If the valve train is to be operated in an internal combustion engine with a disengageable cylinder, then it is proposed according to a preferred embodiment to configure the first or second cam as a base circle without cam stroke.

The invention relates furthermore to an internal combustion engine with a valve train which has been presented above.

Further important features and advantages of the invention will emerge from the subclaims, from the drawings and from the associated figure description with the aid of the drawings.

It shall be understood that the features mentioned above and to be explained further below are able to be used not only in the respectively indicated combination, but also in other combinations or in isolation, without departing from the scope of the present invention.

Preferred example embodiments of the invention are illustrated in the drawings and are explained further in the following description, wherein the same reference numbers refer to identical or similar or functionally identical components.

BRIEF DESCRIPTION OF THE DRAWINGS

There are shown, respectively diagrammatically.

DETAILED DESCRIPTION

Figure 1:
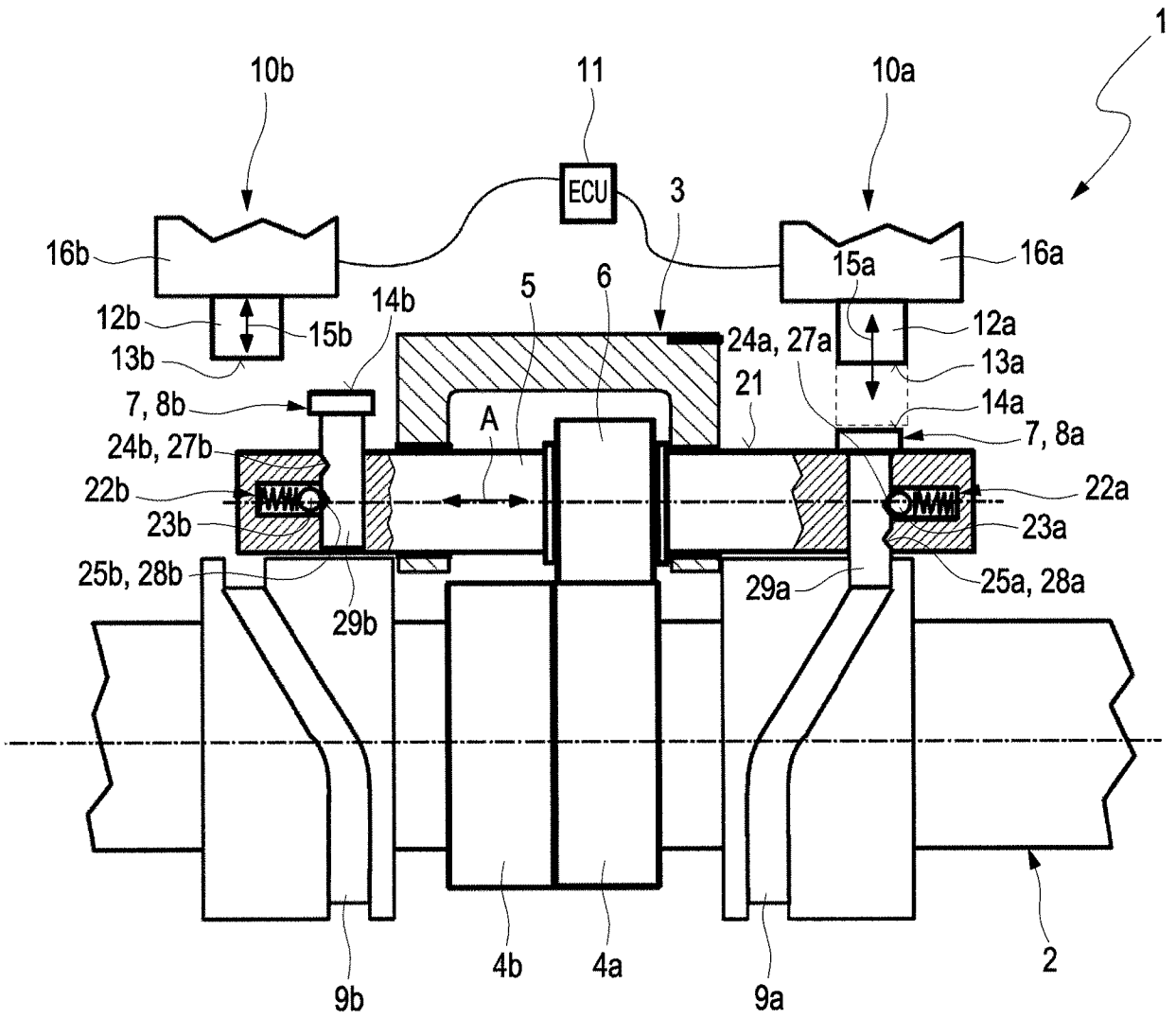
FIG. 1 an example of a valve train according to the invention, with a cam shaft which is arranged in a first axial position, FIG. 2 the valve train of FIG. 1 with the cam shaft in a second position, displaced axially with respect to the first axial position, FIG. 3 a variant of the valve train of FIGS. 1 and 2 with two slide guides arranged on a common slide body.
Figure 2:
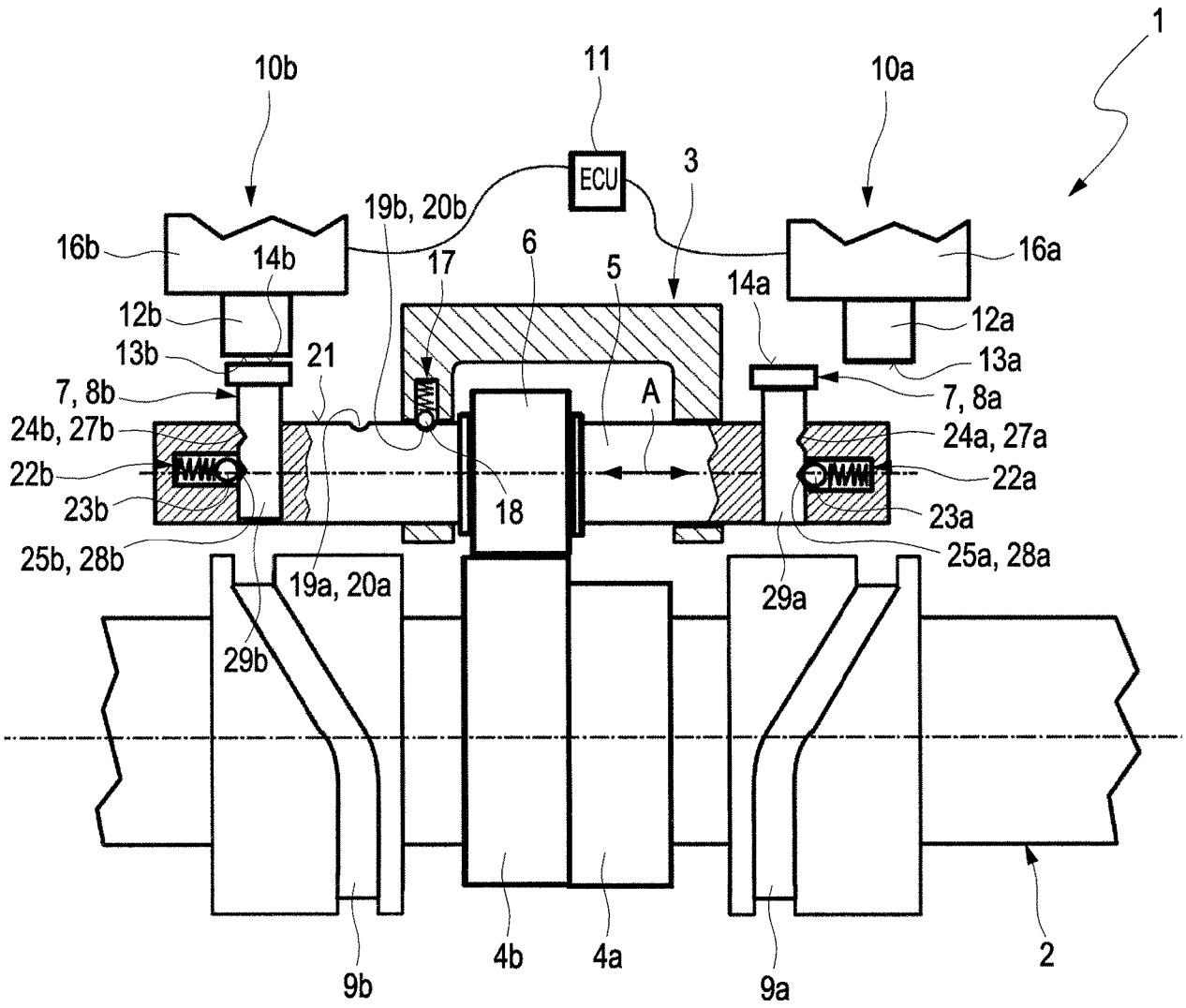

FIGS. 1 and 2 illustrate in a diagrammatic representation an example of a valve train 1 according to the invention. The valve train 1 comprises a cam shaft 2 and a cam follower 3. A first cam 4*a* is mounted for conjoined rotation on the cam shaft 2. A second cam 4*b* is arranged axially adjacent to the first cam 4*a* on the cam shaft 2, likewise for conjoined rotation thereto.

In the example of the figures, the first cam 4*a* is configured as a base circle without a cam stroke. This permits the use of the valve train 1 in an internal combustion engine with a disengageable cylinder.

The cam follower 3 is adjustable along an axial direction A between a first position, in which it is drive-connected to the first cam 4*a*, and a second position, in which it is drive-connected to the second cam 4*b*. FIG. 1 shows the cam follower 3 in said first position, FIG. 2 shows the cam follower 3 in its second position. The cam follower 3 can have a cylindrically configured cam follower base body 5, on the circumferential side of which a cam follower roller 6, configured hollow-cylindrically, is rotatably mounted. The cam follower base body 5 is also known to the relevant specialist in the art under the designation "bolt" or "displacement axis". Via the cam follower roller 6, the drive connection of the two cams 4*a*, 4*b* to the cam follower 3 takes place in a known manner. Here, the rotational movement of the cam shaft 2 by means of the cams 4*a*, 4*b* is converted into a linear movement of the cam follower 3.

In the first position of the cam follower 3, shown in FIG. 1, the cam follower roller 6 is coupled with the first cam 4*a*, in FIG. 2 with the second cam 4*b*. The cam follower roller 6 actuates (not shown) via a suitably configured mechanical coupling device, in particular in the manner of a control element, a valve for adjusting between an open and a closed state. Practical technical realization possibilities of such a coupling are not part of the present invention, but are known to the relevant specialist in the art from the prior art in various forms, so that a more detailed explanation in this respect can be dispensed with.

The cam follower 3 of FIG. 1 has a mechanical adjustment device 7, interacting with the cam shaft 2, for the axial adjustment of the cam follower 3 between the first and the second position. The mechanical adjustment device 7 comprises, for this, a first adjustable mechanical engagement element 8*a*. For the axial adjusting of the cam follower 3 from the first position shown in FIG. 1 into the second position, the first mechanical engagement element 8*a* interacts with a first slide guide 9*a* present on the cam shaft 3. In an analogous manner, the mechanical adjustment device 7 has an adjustable second mechanical engagement element 8*b*. For the axial adjusting of the cam follower 3 from its second into the first position, the second engagement element 8*b* interacts with a second slide guide 9*b* present on the cam shaft 3.

The mechanical adjustment device 7 further comprises a first actuator 10*a*, by means of which the first engagement element 8*a* is adjustable between a first position, shown in FIG. 1, in which it engages into the first slide guide 9*a*, and a second position, shown in FIG. 2, in which it does not engage into the first slide guide 9*a*. The mechanical adjustment device 7 also comprises a second actuator 10*b*, by means of which the second engagement element 8*b* is adjustable between a first position, in which it engages into the second slide guide 9*b*, and a second position, in which it does not engage into said second slide guide 9*b*. The mechanical adjustment device 7 comprises no hydraulic or pneumatic components.

The first actuator 10*a* is adjustable between an inactive position and an active position. For this purpose, the two actuators 10*a*, 10*b* can be configured as linearly adjustable, electrically driven actuators. The mechanical adjustment device 7 is realized in this case as an electromechanical adjustment device. In other words, electrically driven actuators 10*a*, 10*b* are included here by the term "mechanical adjustment device" 7.

The two actuators 10*a*, 10*b* are controllable by a control device 11 of the valve train 1 for adjusting between their active position and their inactive position. This adjustability is realized such that the first actuator 10*a* in the inactive position is out of contact with the first engagement element 8*a*. In the course of an adjusting from its inactive position into its active position, the first actuator 10*a* adjusts the first engagement element 8*a* through mechanical contact from its second into its first position.

The adjusting of the first engagement element 8*a* from the first into the second position can preferably be brought about by means of the stroke movement of the cam follower 3, in particular by means of the cam follower base body 5. Here, the cam follower 3 is moved through the stroke movement brought about by the first or second cam 4*a*, 4*b* in the direction of the first actuator 10*a*. If it is in its active position, then through the stroke movement of the cam follower 3 and thereby of the first engagement element 8*a*, this is pressed against the first actuator 10*a* and is adjusted by it into its second position.

In this state, the first engagement element 8*a* engages into the first slide guide 9*a*, so that the cam follower 3, owing to the rotational movement of the cam shaft 2, by means of the first slide guide 9*a* arranged thereon, is moved axially from its first into the second position. The second actuator 10*b* is also adjustable between an inactive position and an active position. This adjustability is realized such that the second actuator 10*b* in the inactive position is out of contact with the second engagement element 8*b*. In the course of an adjusting from its inactive position into its active position, the second actuator 10*b* adjusts the second engagement element 8*b* through mechanical contact from its second into its first position.

The adjusting of the second engagement element 8*b* from the first into the second position is also preferably brought about by means of the stroke movement of the cam follower 3, in particular by means of the cam follower base body 5. Here, the cam follower 3 is moved through the stroke movement brought about by the first or second cam 4*a*, 4*b* in the direction of the second actuator 8*b*. When the latter is situated in its active position, then through the stroke movement of the cam follower 3 and thereby of the second engagement element 8*b*, the latter is pressed against the second actuator 10*b* and therefore is adjusted by it into its second position.

In this state, the second engagement element 8*b* engages into the second slide guide 9*b*, so that the cam follower 3, owing to the rotational movement of the cam shaft 2, is moved by means of the second slide guide 9*a* arranged thereon axially from its second into the first position.

The first actuator 10*a* has a linearly adjustable (cf. arrow 15*a*) first control element 12*a*. The latter can project partially out from a first housing 16*a* of the first actuator 10*a* and can be arranged so as to be linearly adjustable relative thereto. A face side 13*a* of the first control element 12*a*, facing the first engagement element 8*a*, which can be configured in a pin- or bolt-like manner, presses on moving of the first engagement element 8*a* into the first slide guide 9*a* against a face side 14*a* of the first engagement element 8*a* lying opposite the first control element 12*a*. The second actuator 10*b* has a linearly adjustable (cf. arrow 15*b*) second control element 12*b*. The latter can project partially out from a second housing 16*b* of the second actuator 10*b* and can be arranged so as to be linearly adjustable relative thereto. A face side 13*b* of the second control element 12*b*, facing the second engagement element 8*b*, which can be configured in a pin- or bolt-like manner, presses on moving of the second engagement element 8*b* into the second slide guide 9*b* against a face side 14*b* of the second engagement element 8*b* lying opposite the second control element 12*b*.

As the illustration of FIG. 2 shows, the cam follower 3 also has a cam follower fixing device 17 for the detachable fixing of the cam follower 3 in the first or second position. The cam follower fixing device 17 comprises a spring-loaded cam follower fixing element 18. The cam follower fixing element 18 engages in the first position of the cam follower 3 into a first mount 19*a* provided on the cam follower 3, and in the second position of the cam follower 3 engages into a second mount 19*b* provided on the cam follower 3. Preferably, the first mount 19*a* is realized, as illustrated in FIG. 2, as a first circumferential groove 20*a*, which is arranged on a circumferential side 21 of the cam follower 3. The second mount is realized accordingly as a second circumferential groove 20*b* arranged axially at a distance on the circumferential side 21.

As FIGS. 1 and 2 clearly show, the cam follower 3 has for the two engagement elements 8*a*, 8*b*, preferably for both engagement elements 8*a*, 8*b*, respectively a first or respectively second engagement element fixing device 22*a*, 22*b* for the detachable fixing of the first or respectively second engagement element 8*a*, 8*b* in the first or second position. As can be seen, the two engagement element fixing devices 22*a*, 22*b* have respectively a spring-loaded fixing element 23*a*, 23*b*, which in the first position of the respective engagement element 8*a*, 8*b* is received in a first mount 24*a*, 24*b* provided on the respective engagement element 8*a*, 8*b*. In the second position of the cam follower, the fixing element 23*a*, 23*b* is received in a second mount 25*a*, 25*b* provided on the cam follower. The first and the second engagement element 8*a*, 8*b* have respectively a base body 29*a*, 29*b* configured in a bolt- or pin-like manner. On a circumferential side of the base body 29*a*, 29*b* the first mount 24*a*, 24*b* is configured as a first circumferential groove 27*a*, 27*b*, and the second mount 25*a*, 25*b* as a second circumferential groove 28*a*, 28*b* arranged at a distance on the circumferential side.

With the aid of the illustration of FIGS. 1 and two, an adjusting of the cam follower 3 from the first into the second position is explained below. In the scenario of FIG. 1, the cam follower 3 is situated in the first position, in which its cam follower roller 6 is drive-connected to the first cam 4*a*.

If an adjustment of the cam follower 2 from its first into its second axial position is to take place, then the first engagement element 8*a* of the mechanical adjustment device 7, as shown in FIG. 1, is brought into engagement with the first slide guide 9*a*. This takes place by means of the first electrical actuator 10*a*.

The first actuator 10*a* is, as already explained, adjustable between an inactive position shown in FIG. 1 and an active position indicated in dashed lines in FIG. 1. In the inactive position, the first actuator 10*a* is mechanically out of contact with the first engagement element 8*a*. In the course of an adjusting from its inactive position into its active position, the first actuator 10*a* adjusts the first engagement element 8*a* through mechanical contact from its second into its first position. In the first position, the first engagement element 8*a* engages into the first slide guide 9*a* (cf. FIG. 1), so that the cam follower 3 is moved by the rotational movement of the cam shaft 2 by means of the first slide guide 9*a* axially from its first into its second position, which is illustrated in FIG. 2. After the bringing into engagement of the first engagement element 8*a* with the first slide guide 9*a*, the first actuator 10*a* can be moved back by the control device 11 into its inactive position again.

The first slide guide 9*a* can just as the second slide guide 9*b* have a ramp structure, not shown in the figures, such that the first engagement element 8*a* is brought out of engagement with the first slide guide as soon as the cam follower 3 has reached the second axial position. In this second position, the second cam 4*b* is in drive connection with the cam follower roller 6. The adjusting of the cam follower 3 from the second position back into the first position can take place by means of the second actuator 10*b*, the second engagement element 8*b* and the second slide guide 9*b* in an analogous manner to the previously explained transition from the first into the second position of the cam follower 3.

Figure 3:
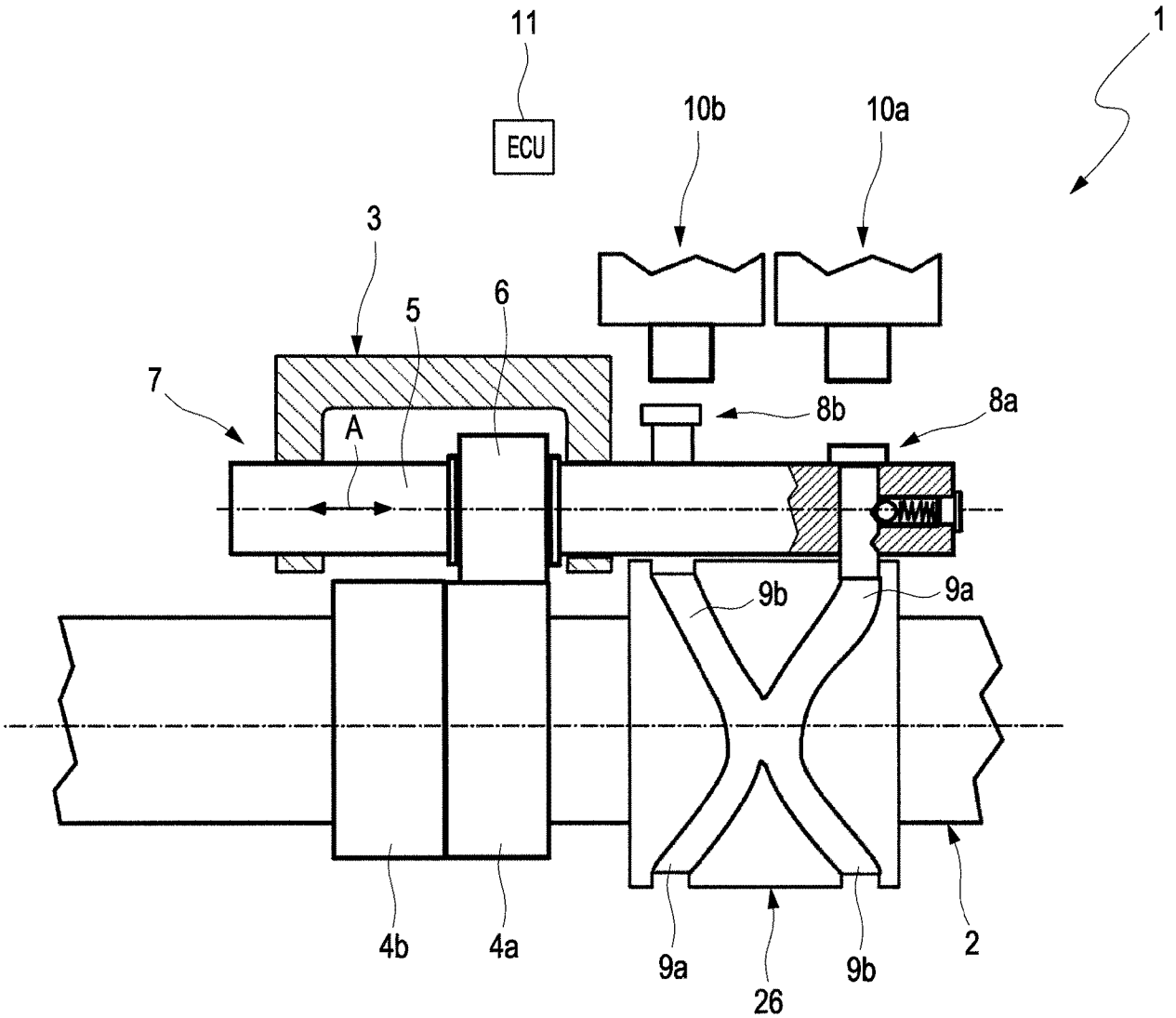

In FIG. 3, a variant of the example of FIGS. 1 and 2 is shown. The valve train 1 of FIG. 3 differs from that of FIGS. 1 and 2 in that the first and second slide guide 9*a*, 9*b* are constructed relative to the two cams 4*a*, 4*b* axially on the same side in a common slide body 26. It is clear that a change to the axial arrangement of the two engagement elements 8*a*, 8*b* and of the two slide guides 9*a*, 9*b* and of the two actuators 10*a*, 10*b* is involved therewith.

The invention claimed is:

1. A valve train for an internal combustion engine, comprising:

a cam shaft;

a cam follower;

a first cam arranged on the cam shaft for conjoined rotation; and a second cam arranged on the cam shaft for conjoined rotation and axially adjacent to the first cam;

the cam follower axially adjustable between a follower first position, where the cam follower is drive-connected to the first cam, and a follower second position, where the cam follower is drive-connected to the second cam;

the cam follower including a mechanical adjustment device interacting with the cam shaft for axially adjusting the cam follower between the follower first position and the follower second position;

the mechanical adjustment device including an adjustable first mechanical engagement element comprising a pin, the adjustable first mechanical engagement element configured to interact with a first slide guide disposed on the cam shaft to axially adjust the cam follower from the follower first position to the follower second position;

the mechanical adjustment device further including an adjustable second mechanical engagement element comprising a pin, the adjustable second mechanical engagement element configured to interact with a second slide guide disposed on the cam shaft to axially adjust the cam follower from the follower second position to the follower first position;

the mechanical adjustment device further including at least one of a first linear actuator and a second linear actuator;

the first linear actuator of the at least one of the first linear actuator and the second linear actuator structured and arranged to adjust the first mechanical engagement element between a first element first position, where the first mechanical engagement element engages into the first slide guide, and a first element second position, where the first mechanical engagement element does not engage into the first slide guide; and the second linear actuator of the at least one of the first linear actuator and the second linear actuator structured and arranged to adjust the second mechanical engagement element between a second element first position, where the second mechanical engagement element engages into the second slide guide, and a second element second position, where the second mechanical engagement element does not engage into the second slide guide.

2. The valve train according to claim 1, wherein:

the first linear actuator of the at least one of the first linear actuator and the second linear actuator is adjustable between a first-inactive position and a first-active position, wherein the first linear actuator is not in contact with the first mechanical engagement element when in the first-inactive position, and wherein the first linear actuator adjusts the first mechanical engagement element through mechanical contact from the first element second position into the first element first position when the first linear actuator is adjusted from the first-inactive position into the first-active position; and the second linear actuator of the at least one of the first linear actuator and the second linear actuator is adjustable between a second-inactive position and a second-active position, wherein the second linear actuator is not in contact with the second mechanical engagement element when in the second-inactive position, and wherein the second linear actuator adjusts the second mechanical engagement element through mechanical contact from the second element second position into the second element first position when the second linear actuator is adjusted from the second-inactive position into the second-active position.

3. The valve train according to claim 2, wherein at least one of:

the first mechanical engagement element is adjusted from the first element first position into the first element second position by a stroke movement of the cam follower; and the second mechanical engagement element is adjusted from the second element first position into the second element second position by a stroke movement of the cam follower.

4. The valve train according to claim 2, further comprising an electronic controller configured to adjust the first linear actuator between the first-active position and the first-inactive position and the second linear actuator between the second-active position and the second-inactive position, wherein the first linear actuator and the second linear actuator are electrically driven actuators.

5. The valve train according to claim 1, wherein:

the first linear actuator of the at least one of the first linear actuator and the second linear actuator includes a linearly adjustable first control element having a face side that presses against a face side of the first mechanical engagement element facing the first control element when the first mechanical engagement element engages into the first slide guide; and the second linear actuator of the at least one of the first linear actuator and the second linear actuator includes a linearly adjustable second control element having a face side that presses against a face side of the second mechanical engagement element facing the second control element when the second mechanical engagement element engages into the second slide guide.

6. The valve train according to claim 5, wherein at least one of:

the first linear actuator includes a first actuator housing, the first control element projecting from the first actuator housing toward the first mechanical engagement element, and wherein the first control element is linearly adjustable relative to the first actuator housing in a direction of the first mechanical engagement element; and the second linear actuator includes a second actuator housing, the second control element projecting from the second actuator housing toward the second mechanical engagement element, and wherein the second control element is linearly adjustable relative to the second actuator housing in a direction of the second mechanical engagement element.

7. The valve train according to claim 1, wherein the first slide guide and the second slide guide are arranged on a same axial side of a common slide body relative to the first cam and the second cam.

8. The valve train according to claim 1, wherein the cam follower further includes a cam follower fixing device for detachably fixing the cam follower in at least one of the follower first position and the follower second position, wherein the cam follower fixing device includes a spring-loaded cam follower fixing element engaging into a follower first mount disposed on the cam follower in the follower first position and engaging into a follower second mount disposed on the cam follower in the follower second position.

9. The valve train according to claim 8, wherein the follower first mount is a first circumferential groove disposed on a circumferential side of the cam follower, and the follower second mount is a second circumferential groove disposed on the circumferential side at an axial distance from the first circumferential groove.

10. The valve train according to claim 1, wherein:

the cam follower further includes at least one engagement element fixing device for detachably fixing at least one of i) the first mechanical engagement element in at least one of the first element first position and the first element second position, and ii) the second mechanical engagement element in at least one of the second element first position and the second element second position;

the at least one engagement element fixing device includes a spring-loaded fixing element engaging an element first mount when at least one of i) the first mechanical engagement element is in the first element first position and ii) the second mechanical engagement element is in the second element first position, and engaging an element second mount when at least one of i) the first mechanical engagement element is in the first element second position and ii) the second mechanical engagement element is in the second element second position; and the element first mount and the element second mount are disposed on at least one of the first mechanical engagement element and the second mechanical engagement element.

11. The valve train according to claim 10, wherein at least one of the first mechanical engagement element and the second mechanical engagement element has an elongated base body, wherein the element first mount is a first circumferential groove and the element second mount is a second circumferential groove, the first circumferential groove and the second circumferential groove arranged an axial distance from one another on a circumferential side of the base body.

12. The valve train according to claim 1, wherein the mechanical adjustment device does not include hydraulic components or pneumatic components.

13. The valve train according to claim 1, wherein one of the first cam and the second cam is configured as a base circle without a cam stroke.

14. The valve train according to claim 1, wherein the mechanical adjustment device includes both of the first linear actuator and the second linear actuator.

15. An internal combustion engine, comprising:

a valve train including:

a cam shaft;

a first cam arranged on the cam shaft for conjoined rotation;

a second cam arranged on the cam shaft for conjoined rotation and axially adjacent to the first cam;

a cam follower including a mechanical adjustment device interacting with the cam shaft for axially adjusting the cam follower between a follower first position, where the cam follower is drive-connected to the first cam, and a follower second position, where the cam follower is drive-connected to the second cam;

the mechanical adjustment device including at least one adjustable mechanical engagement element comprising a pin via which the mechanical adjustment device interacts with the cam shaft and adjusts the cam follower;

the cam follower further including a cam follower fixing device for detachably fixing the cam follower in at least one of the follower first position and the follower second position; and wherein the cam follower fixing device includes a spring-loaded cam follower fixing element engaging into a follower first mount disposed on the cam follower in the follower first position and engaging into a follower second mount disposed on the cam follower in the follower second position.

16. The valve train according to claim 15, wherein:

the at least one mechanical engagement element includes an adjustable first mechanical engagement element comprising a pin, the adjustable first mechanical engagement element configured to interact with a first slide guide disposed on the cam shaft to axially adjust the cam follower from the follower first position to the follower second position; and the at least one mechanical engagement element further includes an adjustable second mechanical engagement element comprising a pin, the second mechanical engagement element configured to interact with a second slide guide disposed on the cam shaft to axially adjust the cam follower from the follower second position to the follower first position.

17. The valve train according to claim 16, wherein:

the mechanical adjustment device further includes a first linear actuator for adjusting the first mechanical engagement element between a first element first position, where the first mechanical engagement element engages into the first slide guide, and a first element second position, where the first mechanical engagement element does not engage into the first slide guide; and the mechanical adjustment device further includes a second linear actuator for adjusting the second mechanical engagement element between a second element first position, where the second mechanical engagement element engages into the second slide guide, and a second element second position, where the second mechanical engagement element does not engage into the second slide guide.

18. The valve train according to claim 17, wherein:

the first linear actuator is adjustable between a first-inactive position and a first-active position, wherein the first linear actuator is not in contact with the first mechanical engagement element when in the first-inactive position, and wherein the first linear actuator adjusts the first mechanical engagement element through mechanical contact from the first element second position into the first element first position when the first linear actuator is adjusted from the first-inactive position into the first-active position; and the second linear actuator is adjustable between a second-inactive position and a second-active position, wherein the second linear actuator is not in contact with the second mechanical engagement element when in the second-inactive position, and wherein the second linear actuator adjusts the second mechanical engagement element through mechanical contact from the second element second position into the second element first position when the second linear actuator is adjusted from the second-inactive position into the second-active position.

19. The valve train according to claim 18, wherein at least one of:

the first mechanical engagement element is adjusted from the first element first position into the first element second position by a stroke movement of the cam follower; and the second mechanical engagement element is adjusted from the second element first position into the second element second position by a stroke movement of the cam follower.

20. A valve train for an internal combustion engine, comprising:

a cam shaft;

a first cam arranged on the cam shaft for conjoined rotation;

a second cam arranged on the cam shaft for conjoined rotation and axially adjacent to the first cam;

a cam follower including a mechanical adjustment device interacting with the cam shaft for axially adjusting the cam follower between a follower first position, where the cam follower is drive-connected to the first cam, and a follower second position, where the cam follower is drive-connected to the second cam;

a common slide body disposed on the cam shaft to axially adjust the cam follower between the follower first position and the follower second position, the common slide body including a first slide guide and a second slide guide arranged on a same axial side of the common slide body with regard to the first cam and the second cam;

the mechanical adjustment device interacting with the cam shaft and adjusting the cam follower via at least one adjustable mechanical engagement element structured as a pin engaging in at least one of the first slide guide and the second slide guide;

wherein the cam follower further includes a cam follower fixing device for detachably fixing the cam follower in at least one of the follower first position and the follower second position, the cam follower fixing device including a spring-loaded cam follower fixing element engaging into a mount provided on the cam follower when the cam follower is in at least one of the follower first position and the follower second position.

* * * * *